United States Patent [19]

Randén

[11] Patent Number: 4,591,200

[45] Date of Patent: May 27, 1986

[54] LIFTING WEDGE

[75] Inventor: Ilkka Randén, Rauma, Finland

[73] Assignee: Lassila & Tikanoja Oy, Turku, Finland

[21] Appl. No.: 698,503

[22] Filed: Feb. 1, 1985

[30] Foreign Application Priority Data

Jun. 2, 1984 [FI] Finland ..... 840466

[51] Int. Cl.[4] ..... B66C 1/54

[52] U.S. Cl. ..... 294/96; 294/89

[58] Field of Search ..... 294/86.24, 86.25, 89, 294/93, 94, 96; 24/136 K; 254/104; 279/2 R; 403/314, 343, 367–369, 374; 411/75–80; 414/911

[56] References Cited

U.S. PATENT DOCUMENTS

| | | | |
|---|---|---|---|
| 822,769 | 6/1906 | Quist | 294/89 |
| 880,962 | 3/1908 | Blanchard et al. | 294/89 |
| 989,757 | 4/1911 | Boroff | 294/86.25 X |
| 2,988,396 | 6/1961 | Davies | 294/93 |
| 3,709,546 | 1/1973 | Vaughan | 294/96 |
| 3,758,146 | 9/1973 | Kaercher | 294/94 |
| 3,915,489 | 10/1975 | Murphy | 294/96 |
| 3,993,341 | 11/1976 | Bentley | 294/89 |

FOREIGN PATENT DOCUMENTS

| | | | |
|---|---|---|---|
| 218567 | 5/1961 | Austria | 294/96 |
| 178467 | 3/1966 | U.S.S.R. | 294/89 |
| 481521 | 11/1975 | U.S.S.R. | 294/89 |

*Primary Examiner*—Johnny D. Cherry

*Attorney, Agent, or Firm*—Holman & Stern

[57] ABSTRACT

The present invention relates to a lifting wedge which is intended in particular for lifting a paper roll in the vertical position, and which is made up of a substantially cylindrical lifting wedge part (1) having the cross sectional shape of the core hollow of the paper roll, a lifting belt (2) fitted to the lifitng wedge, and friction surfacing (3). The lifting wedge accompanies during transport the roll to be lifted.

Previously known lifting devices of this type consist of lifting belts which are passed around paper rolls in the vertical position. The assembling of the belts and fitting them around the rolls is relatively difficult.

The lifting wedge part (1) according to the invention is divided in its longitudinal direction preferably into three wedge-shaped sections. The lifting belt (2) encircles that wedge section which has a larger cross sectional surface in its lower part, and forms a lifting loop above the wedge section. When the lifting belt is tightened, the wedge section encircled by it presses against the outer wedge sections, whereupon the friction surfacing (3) on the circumference of the lifting wedge presses against the inner wall of the core hollow and causes the lifting wedge to adhere reliably to the core hollow. The lifting wedge can be of wood and sawn into wedge sections, or it can be cast into wedge-shaped sections. The friction surfacing is preferably in the form of a rubber belt, or it can be friction-increasing material on the surface of the wedge sections. Band or rope can be used for the lifitng belt.

8 Claims, 5 Drawing Figures

LIFTING WEDGE

Figure 1:
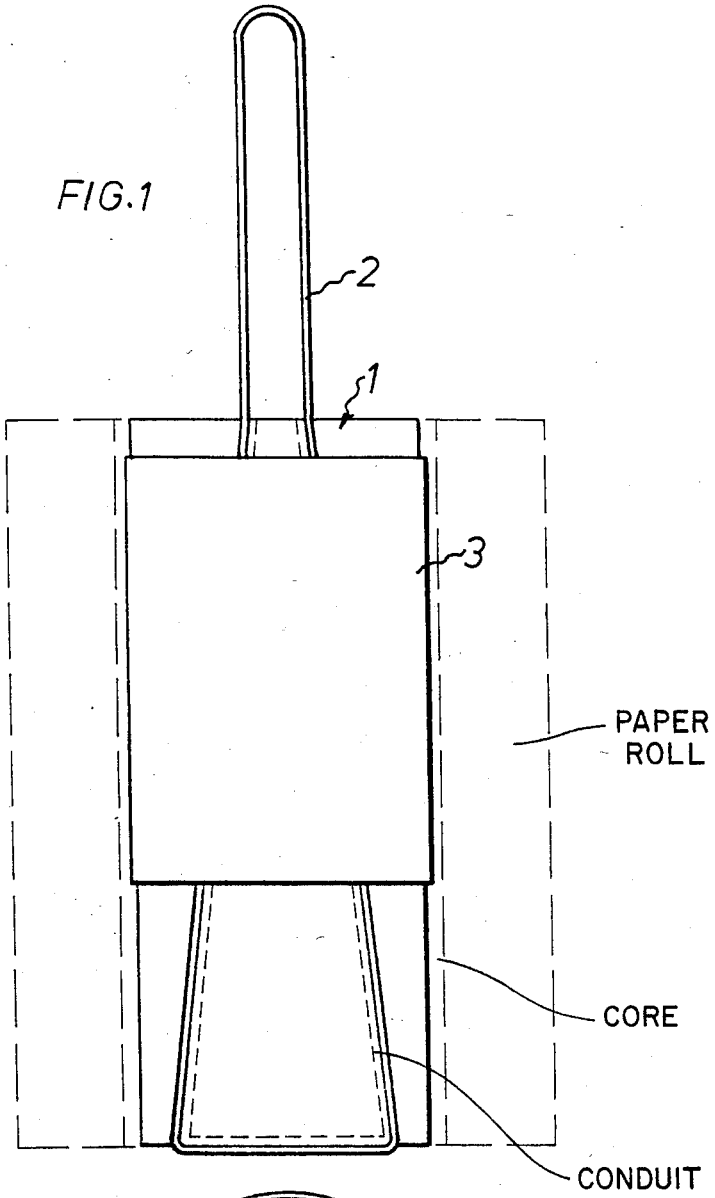

The present invention relates to a lifting wedge and in particular to a lifting wedge which is intended for lifting in the vertical position an object provided with a core hollow having a circular or substantially circular cross section, in particular a paper roll, and which is made up of a substantially cylindrical lifting wedge having the cross sectional shape of the core hollow, of a lifting belt fitted to the lifting wedge, and of friction surfacing. Such a lifting wedge remains in the object during transport and is removed at the destination.

Previously known there are various lifting devices for lifting paper rolls when they are in the vertical position, such devices accompanying the object to be lifted. These devices are most commonly in the form of different lifting belts, which are passed around one or usually two adjacent rolls, in which case the lifting loop of the lifting belt is caught by the lifting hook. The lifting belts are made up of different loops, and it may be difficult to place them correctly around the roll.

The delicate nature of paper rolls must be taken into account in the design of all paper-roll lifting devices. The surfaces of paper rolls must not be damaged, and no depressions must be formed at their ends or in the core hollows. Such depressions would be seen as defects in the final product or would cause difficulties in the use of the paper rolls, during the printing process, for example.

The lifting device according to the invention deviates completely from the previously known solutions, and it has been possible by means of it to eliminate the disadvantages of known devices.

The lifting efficiency of the lifting wedge according to the invention is based on the wedge effect and on friction between the core hollow of the object to be lifted and the lifting wedge. The cylindrical lifting wedge, having a cross sectional shape substantially that of the core hollow of the object to be lifted, is cut in the longitudinal direction into wedge-shaped sections, which, when assembled together, form the cylindrical shape of the initial piece. The lifting belt is passed around that wedge section which, as seen in the lifting direction, is larger in its lower part, and above the lifting wedge it forms a part which is fitted to the lifting hook. On the exterior surface of the lifting wedge there is a substance which increases friction.

Such a lifting wedge made up of wedge-shaped sections is fitted into the core hollow of the object to be lifted, in a position in which the wedges are dislocated in relation to one another and their joint circumference is thus smaller. By pressing to inside the core hollow the protruding wedge sections which have a smaller lower part, the diameter of the lifting wedge is expanded, and the higher-friction surfacing on its exterior surface presses against the wall of the core hollow. As seen from above, the lifting belt passes down between two wedge sections, turns there around that wedge section which has a larger lower part, passes up between this and the other wedge section, and a lifting loop is formed at the top in the lifting belt. When the lifting loop is fitted into the lifting hook and the hook is raised, the belt tightens and causes the wedge section encircled by the lifting belt to move upwards as much as is still possible within the diameter of the core hollow. The produced compressive force causes a very high friction force between the wall of the core hollow and the friction surfacing of the lifting wedge. The lifting wedge adheres reliably to the core hollow, and lifting is effected with a satisfactory reliability. In the experiments carried out the reliability coefficient has been in the order of 3.5.

According to a preferred embodiment, the lifting wedge is divided into three parts by two oblique plane sections which approach each other in the upward direction. In this case the lifting belt is passed around the central part.

That surface of the lifting wedge which is covered by the friction-increasing material is preferably about $\frac{7}{8}$ of the length of the wedge.

Advantageously a suitable belt, which holds the sections together, is fitted around the separate wedge sections. The belt may be separate or, for example, secured to at least one exterior wedge section. The belt holding the wedges together of course facilitates work with the lifting wedge.

According to a preferred embodiment, this belt is of a friction-increasing material, for example rubber, in which case it can replace the friction-increasing material on the exterior surface. Such a friction belt is preferably in the form of a sleeve of rubber material.

The lifting wedge itself is of wood or plastic, for example.

The lifting of paper rolls or other similar objects with the aid of the lifting wedge according to the invention is very easy. A lifting wedge is fitted into each roll to be lifted, which can be done very quickly by using a suitable auxiliary tool. Such a tool has preferably two branches and at the upper end of the branches a horizontal support and a suitable handle. The distance between the branches is somewhat greater than the width of the central wedge section, in which case the branches come over those wedge sections which protrude from the core hollow and have a smaller lower part. By holding the belt, the lifting wedge is fitted in a loose, small-diameter position into the core hollow. The wedge is tightened into place by pulling the belt, and the auxiliary tool is fitted over the side wedge sections as deep as allowed by the horizontal support. The height of the branches from their ends to the horizontal support is preferably about 120 mm, which leaves a part of the same height of the core hollow between the lifting edge and the end surface of the roll. When so desired, the belt loop can be lowered into this bollow. Especially if it is desired to protect the end of the roll from rain by means of some cover, it is advantageous to place the loop inside the core hollow. The total length of the loop is preferably about 800–1000 mm, in which case a loop of a suitable size protrudes from the end.

The lifting wedge can be fitted into a roll even at the mill in connection with the production or the reeling of the rolls, or this can be done at the harbor or at some stage between these. The fact that the lifting wedge can be fitted into the roll even at the mill and can travel with the roll all the way to the place of use is the great advantage of this invention. The procedure does not cause much additional work or additional arrangements in connection with the manufacture, which it does when carried out at the harbor.

The removal of the lifting wedge at the place of final use, for example, a printing house, harbor or other place, is again very easy by using a suitable auxiliary tool. The lower support of such a tool is fitted over the central wedge section, in which case, when the tool is struck against a striking stop, the central section presses somewhat deeper in relation to the outer wedge sections. Thereby the hold of the lifting wedge in the core hollow is loosened up, and the wedge can be lifted out. The removal of the wedge causes the least additional work and the fewest additional arrangements when it is carried out at the place of final use.

The lifting wedges are made preferably from birchwood. Turned material of suitable dimensions is available advantageously even as a waste product of other production plants. The sawing of the wedges can be done simply by using, for example, a band saw. The raw material and manufacturing costs of the lifting wedge are thus very low.

Of course, it is also possible to cast the wedge sections of the lifting wedge from plastic. In this case the necessary friction surface can be formed directly on the outer surface of the wedge sections. In order to facilitate the use of the lifting wedge it is advantageous to hold the wedge sections together by means of a separate belt having a circumference only somewhat larger than the diameter of the core opening. The belt advantageously adheres to the wedge sections by friction. Such a belt can also be secured to one or two outer wedge sections.

In terms of the use and efficiency it is, however, most advantageous to use a sleeve-shaped belt of rubber or a similar sheet-like material over the wedge sections, the belt functioning both as a friction surface and as a member which holds the wedge sections together.

The lifting belt used is preferably a band made from synthetic fiber. The width of the band is about 50 mm, in which case the strength is sufficient. It can also be considered that the band is replaced by a rope or the like. When rope is used as the lifting belt it is advantageous to form a groove in one or both of the wedge surfaces between which it runs.

Figure 2:
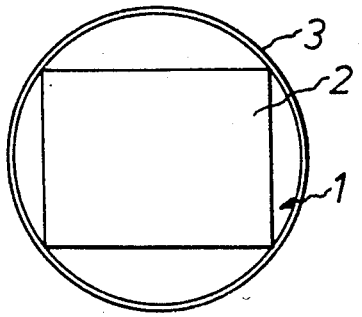
Figure 5:
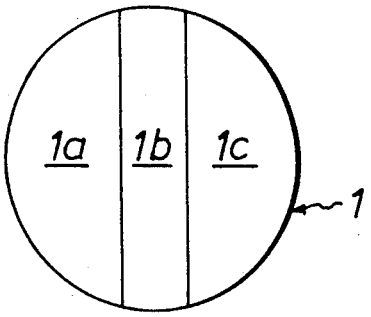
Figure 3:
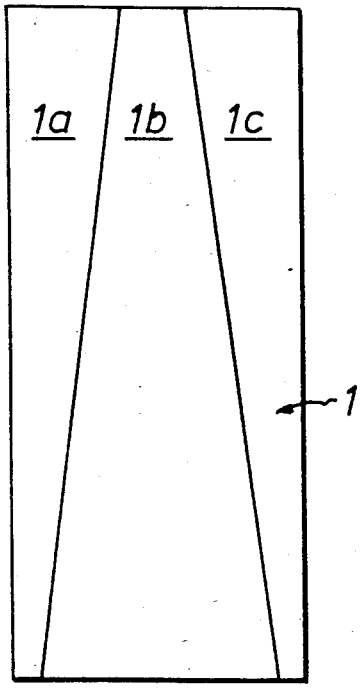
Figure 4:
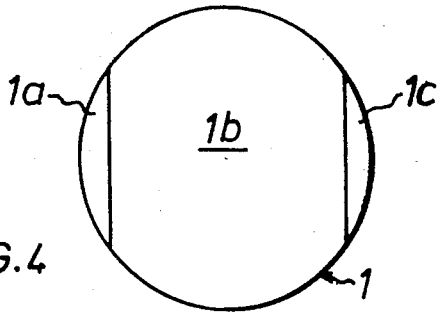

One preferred embodiment of the lifting wedge according to the invention is described below with reference to the accompanying figures. FIG. 1 depicts a front view of the lifting wedge in the operating position. FIG. 2 depicts the lifting wedge according to FIG. 1 as seen from below, FIG. 3 depicts a wooden piece used as a lifting wedge, sawn into wedge-shaped sections, FIG. 4 depicts the same as FIG. 3, seen from below, and FIG. 5 depicts the same as FIG. 3, seen from above.

The same parts in the different figures are indicated by the same reference numerals. The wedge part of the lifting wedge is indicated by numeral 1, the lifting belt by 2, the friction belt by 3. The three wedge sections of the depicted lifting wedge are indicated by 1*a*, 1*b* and 1*c*.

The figures show that the band functioning as the lifting belt 2 encircles the central wedge section and forms a lifting loop above the wedge. A suitable length for the wedge is about 200 mm and a suitable width for the friction belt about 150 mm. The belt is fitted over the wedge sections in such a way that about 10–20 mm of bare wedge surface is left at the upper edge and respectively 40–30 mm at the lower edge. The width of the band is about 50 mm. The size of the angles of the wedge sections and respectively the widths of the end surfaces are clearly evident from FIGS. 3, 4 and 5.

The invention is not confined to the embodiment depicted above, but it can be varied without deviating from the inventional idea, which consists of the adherence to the core hollow of a paper roll or the like, of a lifting device to be fitted in the said core hollow, the adherence withstanding lifting and being based on wedge pressure and a friction surface.

For example, the lifting belt passed around a wedge section can be replaced by a lifting loop secured to the said wedge section. The lifting loop can, for example, be passed through a bore formed in the wedge section and be anchored to its base.

It is also possible to replace the lifting wedge formed from three wedge sections by a cylindrical exterior part, in the center of which there is formed a hollow having the shape of a truncated cone, and by a piece of a respective shape fitted inside this hollow, the lifting belt being secured to this piece. In order to make use of wedge pressure, the exterior part must have a flexible circumference, for example produced by means of an articulation system.

I claim:

1. A lifting wedge for an elongate article having a tubular cylindrical core, the wedge comprising three separate wedge elements which fit together to form a cylinder, the elements comprising a central element and outer elements having adjacent interfitting planar longitudinal surfaces which converge from one end of the cylinder to the other end of the cylinder so that the central element has a larger end surface at said one end of the cylinder and a smaller end surface at the other end of the cylinder while the outer elements have smaller end surfaces at said one end of the cylinder and larger end surfaces at the other end of the cylinder, an endless lifting belt entrained longitudinally around the central element, the belt having a lifting loop extending from the other end of the cylinder, and means defining a friction-increasing peripheral outer surface for the cylinder.

2. A lifting wedge according to claim 1, wherein the lifting belt is a rope.

3. A lifting wedge according to claim 1, wherein the lifting belt passes around the central element via a conduit formed in that element and is anchored to its base.

4. A lifting wedge according to claim 1, wherein the means defining a friction-increasing peripheral outer surface covers about three-quarters of the length of the cylinder.

5. A lifting wedge according to claim 1, wherein the means defining a friction-increasing peripheral outer surface comprises a friction belt extending around the cylinder.

6. A lifting wedge according to claim 1, wherein the wedge elements are formed of a material selected from a group consisting of wood and plastic materials.

7. A lifting wedge according to claim 1, wherein the length of the cylinder is about three times its diameter.

8. A lifting wedge according to claim 1, in combination with a paper roll having a cylindrical core, the wedge being inserted in the core with the loop extending from one end of the roll.

* * * * *